United States Patent [19]

Gassowski

[11] 4,214,838

[45] Jul. 29, 1980

[54] ADVANCE AND TRANSFER MECHANISM FOR INKED RIBBON OR THE LIKE

[75] Inventor: Jerzy R. Gassowski, Burbank, Calif.

[73] Assignee: International Telephone and Telegraph Corporation, New York, N.Y.

[21] Appl. No.: 937,047

[22] Filed: Aug. 28, 1978

[51] Int. Cl.[3] ..... B41J 33/48

[52] U.S. Cl. ..... 400/220.1; 400/236.1

[58] Field of Search ..... 400/218, 219, 220, 220.1, 400/220.2, 236.1; 101/99, 110

[56] References Cited

U.S. PATENT DOCUMENTS

| | | | |
|---|---|---|---|
| 1,543,286 | 6/1925 | Grandjean | 400/220 |
| 2,505,991 | 5/1950 | Reinhold | 400/220.1 X |
| 2,906,203 | 9/1959 | Grosse | 400/220 X |
| 2,986,260 | 5/1961 | Whippo | 400/220.1 X |
| 3,771,442 | 11/1973 | Ditman | 101/99 |
| 3,819,028 | 6/1974 | Drillick | 400/220 X |
| 3,976,185 | 8/1976 | Aebi | 400/220 X |

FOREIGN PATENT DOCUMENTS

| | | | |
|---|---|---|---|
| 213924 | 3/1961 | Austria | 400/220.1 |

*Primary Examiner*—Edward M. Coven
*Attorney, Agent, or Firm*—A. Donald Stolzy

[57] ABSTRACT

Two arms carry two pawls each. One pawl of each arm engages one ratchet wheel and, alternately, the other pawl of each arm engages another ratchet wheel when the arms are moved at the end of the travel of a ribbon. The ratchet wheels carry ribbon spools. One arm carries push pawls. The other carries pull pawls. The push pawls act as no-backs, but they also drive the ratchet wheels. Each ratchet wheel is thus positively driven more or less continuously when it is driven. The ratchet wheels are driven alternately. An over-center transfer mechanism places a desired pair of pawls in position for ratchet wheel engagement and the other pair for disengagement at each end of the ribbon travel.

14 Claims, 9 Drawing Figures

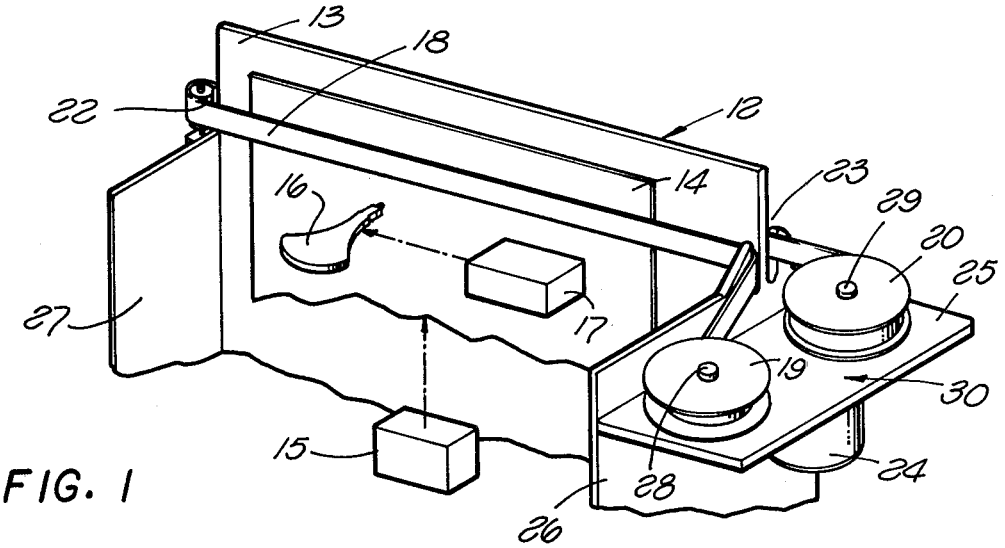
FIG. 1
FIG. 9
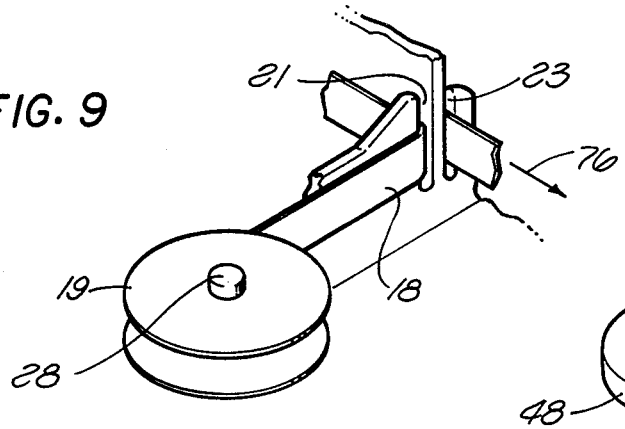
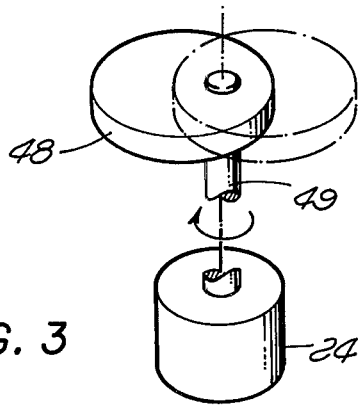
FIG. 3

ADVANCE AND TRANSFER MECHANISM FOR INKED RIBBON OR THE LIKE

BACKGROUND OF THE INVENTION

This invention relates to apparatus for advancing a ribbon for a printer or the like, and more particularly to a mechanism for causing a ribbon to traverse a print position and to reverse direction at the end of its travel.

PRIOR ART STATEMENT

In the past it has been the practice to support two ribbon spools for rotation about parallel axes fixed relative to corresponding ratchet wheels. A single reciprocable arm is then provided with a pawl at each end. At the end of its travel the ribbon resists rotation of one ratchet wheel while a pawl engages it, the other pawl being disengaged. Resistance to rotation as foresaid causes the one ratchet wheel to disengage while the other engages the other ratchet wheel to reverse the direction of movement of the ribbon.

Unfortunately the prior art ribbon advance and transfer mechanism requires a large drag to keep the ribbon from causing a ribbon and spool reverse movement and/or from preventing advancement due to the elasticity of the ribbon itself. The large drag also requires a large motor and more power for the prior art mechanism.

SUMMARY OF THE INVENTION

According to the present invention, the above-described and other disadvantages of the prior art are overcome by providing a printer or the like with an inked ribbon advance mechanism that keeps the ribbon in tension at substantially all times or limits reverse movement to a fraction of the increment that the ribbon is advanced.

BRIEF DESCRIPTION OF THE DRAWINGS

In the accompanying drawings which illustrate exemplary embodiments of the present invention:

FIG. 1 is a broken away perspective view of a printer constructed in accordance with the present invention;

FIG. 3 is a perspective view of a drive arrangement for the mechanism of FIG. 2;

FIG. 9 is a perspective view illustrating a stop for an inked ribbon.

DESCRIPTION OF THE PREFERRED EMBODIMENT

Figure 2:
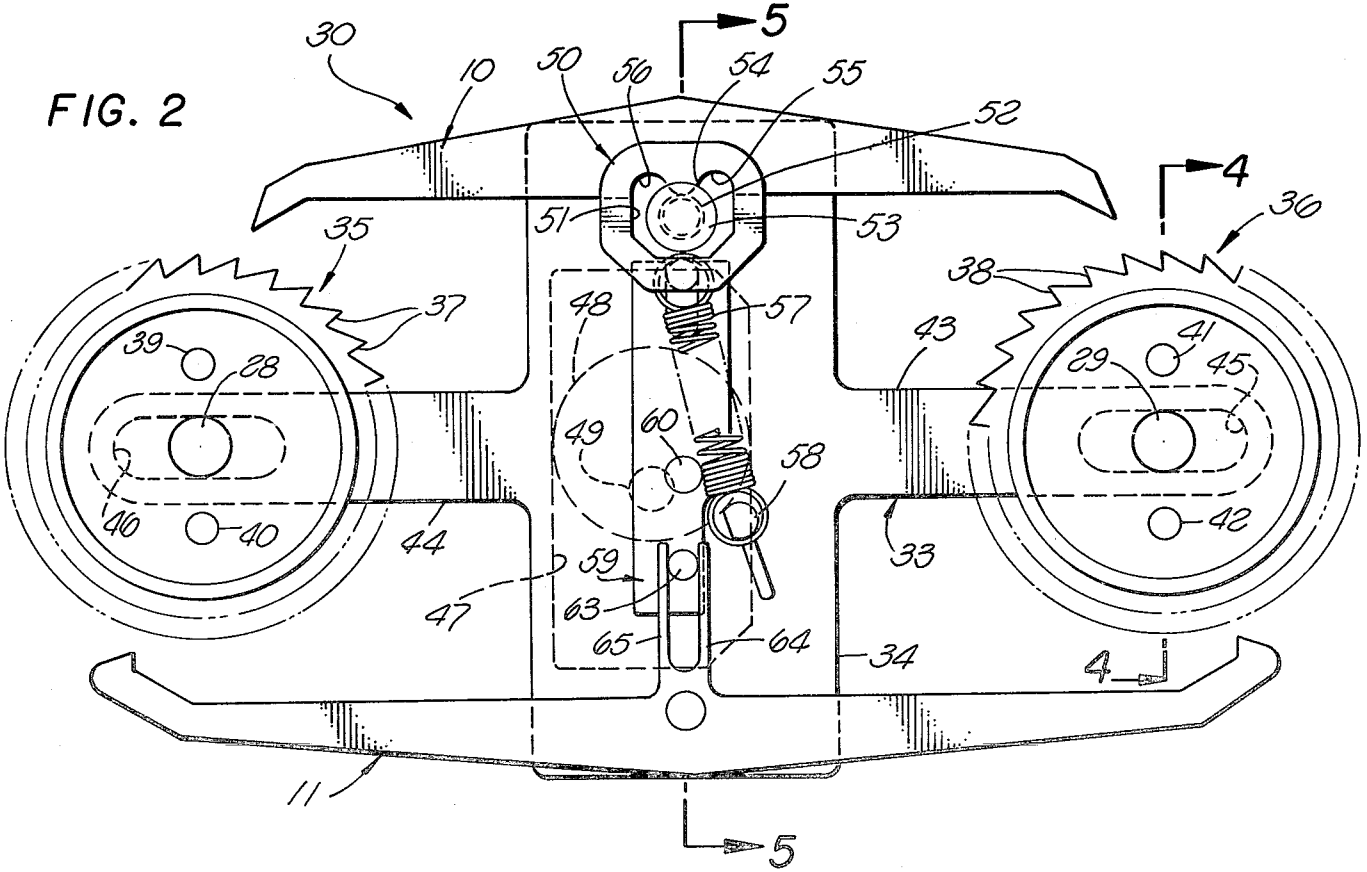
FIG. 2 is an enlarged top plan view of a ribbon advance mechanism constructed in accordance with the present invention.

A portion of one embodiment of the present invention is illustrated in FIG. 1. If desired, the portion shown in FIG. 1 may be entirely conventional. An inked ribbon advance mechanism shown in FIG. 2 is new in accordance with the present invention. However, even an arm 10 shown in FIG. 2 is old in the art. However, an arm 11 is new and the connection between arms 10 and 11 is new.

In FIG. 1, a frame is provided at 12 having a plate 25 and a platen 13 against which a roll of paper is unwound at 14. Paper 14 is guided and moved by a mechanism 15.

Although printing may be accomplished by any or all of conventional means, a mosaic print head 16 may be employed, if desired. Print head 16 may be of the teleprinter type or of any other conventional type. Print head 16 is controlled by means 17 to move in a horizontal direction. Print head 16 is shown spaced from an inked ribbon 18. However, print head 16 may be located much closer thereto, FIG. 1 only being diagrammatic.

Inked ribbon 18 is rolled up on spools 19 and 20 alternately as in a typewriter. Each end of the ribbon is fixed to its corresponding spool as is conventional. The mechanism shown in FIG. 2 is new, and it is this mechanism which rotates spools 19 and 20 alternately. Ribbon 18 extends from spool 19 through a slot 21 shown in FIG. 9 around a pulley 22 shown in FIG. 1, along the back of platen 13, through a slot 23 shown in FIGS. 1 and 9 to spool 20.

Actually, the only portion of the present invention shown in FIG. 1 is a constant speed motor 24 which is fixed to a plate 25 that is, in turn, fixed to a side plate 26 of frame 12, frame 12 having another side plate 27 at its opposite end. However, shafts 28 and 29 may be regarded as portions of the invention because the advance of the spools 19 and 20 is around shafts 28 and 29, respectively. Alternatively, shafts 28 and 29 may be fixed to spools 19 and 20, respectively, and rotatable through holes, not shown, in plate 25.

A major portion of the invention is located between spools 19 and 20 at 30 in FIG. 1, but is not shown there for clarity.

Figure 4:
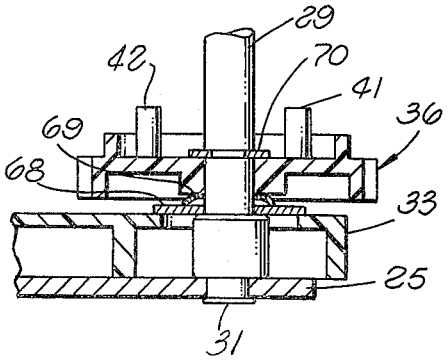
FIG. 4 is a transverse sectional view through the mechanism taken on the line 4—4 shown in FIG. 2.

Shaft 29 is shown in FIG. 4. In FIG. 4, note will be taken that shaft 29 is rotatably fixed to plate 25 between snap ring 70 and flange 31.

In FIG. 2, shaft 29 is again shown with shaft 28. A plate 33 is slidable vertically, as viewed in FIG. 2. Except for plate 33, arms 10 and 11, and the structures shown within an enlarged central portion 34 of plate 33, the shafts 28 and 29, and the structures therearound may be more or less symmetrical about the axes of shafts 28 and 29.

Shaft 28 may be mounted in the same way that shaft 29 is and as shown in FIG. 4. The structures surrounding shaft 29 may be similar to the structures surrounding shaft 28, and as shown in FIG. 4.

Notwithstanding the foregoing, ratchet wheels 35 and 36 are provided about axes of shafts 28 and 29, respectively, and ratchet wheels 35 and 36 are not exactly symmetrical. They are not symmetrical at least to the extent that the teeth 37 of ratchet wheel 35 are not exactly symmetrical and the teeth 38 of ratchet wheel 36 are not exactly symmetrical. Further, ratchet wheel 35 has two pins 39 and 40 which fit into corresponding holes, not shown, of spool 19. Each of the ratchet wheels 35 and 36, when egaged by two pawls, may be rotated one ratchet wheel tooth for one continuous increment of rotation; i.e. for two teeth, three teeth, etc., as desired. Spools 19 and 20 may be entirely conventional.

Ratchet wheel 36, in FIG. 4, has two pins 41 and 42.

Plate 33 in FIG. 2 has upper and lower portions 43 and 44 that have slots 45 and 46 therein, respectively, which are slidable back and forth, as viewed in FIG. 2, over shafts 29 and 28, respectively.

Plate 33 slides on the top surface of plate 25 shown in FIG. 1 underneath spools 19 and 20. However, see 33 in FIG. 4.

Plate portion 34, in FIG. 2, has a recess 47 therein in which a cam 48 moves when rotated about the axis of a motor shaft 49. See FIG. 3. Cam 48 is fixed to shaft 49.

Arms 10 and 11 are shown in approximately symmetrical position in FIG. 2. However, arms 10 and 11 are not normally in the position shown in FIG. 2, but only assume such positions briefly during a transitional movement of the mechanism of FIG. 2 in transferring the drive from ratchet wheel 35 to ratchet wheel 36 and vice versa.

As is conventional, pins 39 and 40 and the balance of ratchet wheel 35 may be an integrally molded plastic part. The same is true of pins 41 and 42 and ratchet wheel 36. Integral molded parts may be used throughout most of the construction.

For example, arm 10 may have an integral body 50 that has an irregular ring shape including a somewhat heart-shaped aperture 51. A pin 52 projects upwardly through aperture 51. Pin 52 has a flange 53 which rests on the top surface of body 50. Body 50 has a projection 54 which momentarily rests upon shaft 52 as it moves to the right and to the left during transfer. Thus, the stable positions of arm 10 are shown in FIG. 6.

Figure 6:
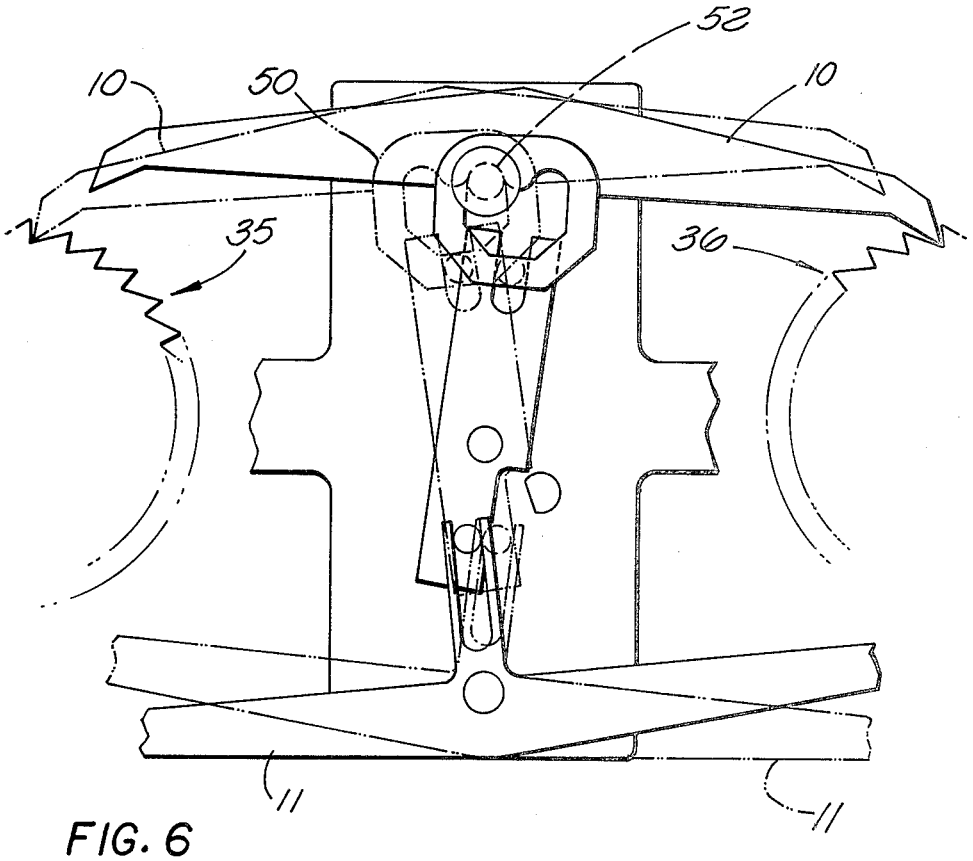
FIG. 6 is an operational view of the mechanism shown in FIG. 2.

In FIG. 6, pin 52 rests in a cradle 55 shown in FIG. 2 in the dotted line position of body 50. Pin 52 rests in cradle 56 (FIG. 2) in the solid line position of body 50 shown in FIG. 6.

Figure 5:
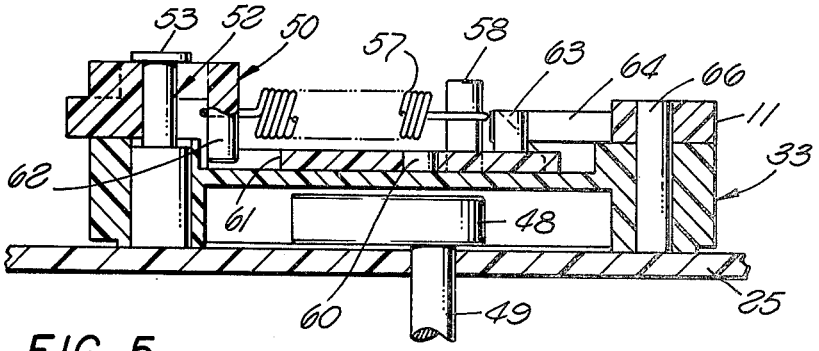
FIG. 5 is a transverse sectional view of the mechanism taken on the line 5—5 shown in FIG. 2.

A spring 57 shown in FIG. 2 is connected to body 50 and a pin 58 as shown in FIGS. 2 and 5 to bias body 50 to one of the two over center positions shown in solid and dotted lines, respectively, in FIG. 6.

A block 59 is guided in any conventional manner to rotate on plate portion 34 about a pin 60 as shown in FIGS. 2 and 5. Block 59 has a slot 61 which straddles a pin 62 integral with body 50. Thus, when body 50 rotates, block 59 rotates, and arm 11 is rotated by a pin 63 fixed to block 59. Pin 63 is shown in FIGS. 2 and 5. Pin 63 extends upwardly between leaf springs 64 and 65 molded integrally with arm 11.

Pin 62 is the same pin about which one end of spring 57 is connected. As shown in FIG. 5, arm 11 is rotatable about pin 66 fixed to the plate 25.

Motor 24 may be fixed to plate 25 in FIG. 1 in any conventional manner. Of course, motor 24 will not be supported from cam 48 as shown in FIG. 5. The motor housing and substantially its entire weight is supported from plate 25 by screws or other conventional fastening means.

Although not shown, pin 66 may project above the upper surface of arm 11, and a snap ring may hold arm 11 down. Pin 52 is held in a fixed position relative to plate 33 in FIG. 5.

In FIG. 4, ratchet wheel 36 is held around shaft 29 between a snap ring 70, a washer 68 and a conventional wave spring 69.

Only one of the ratchet wheels 35 and 36 is driven at a time. In FIG. 6, ratchet wheel 36 is driven when pin 52 rests in cradle 56. Ratchet wheel 35 is driven when pin 52 rests in cradle 55.

Figure 8:
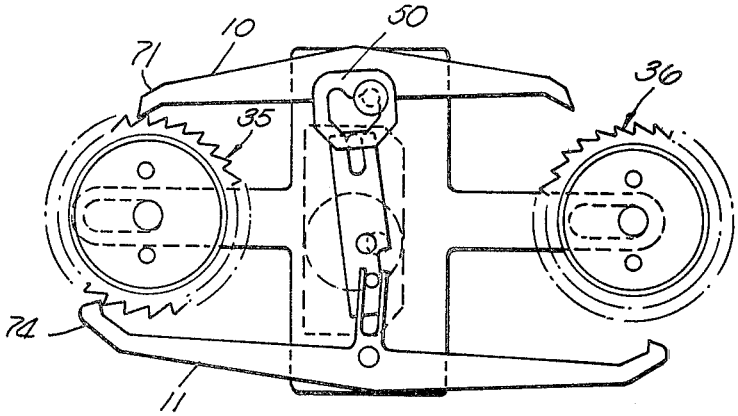
FIG. 8 is an operational view showing a pull pawl engaging a ratchet wheel, and a push pawl disengaging the ratchet wheel, all of which are shown in FIG. 2.
Figure 7:
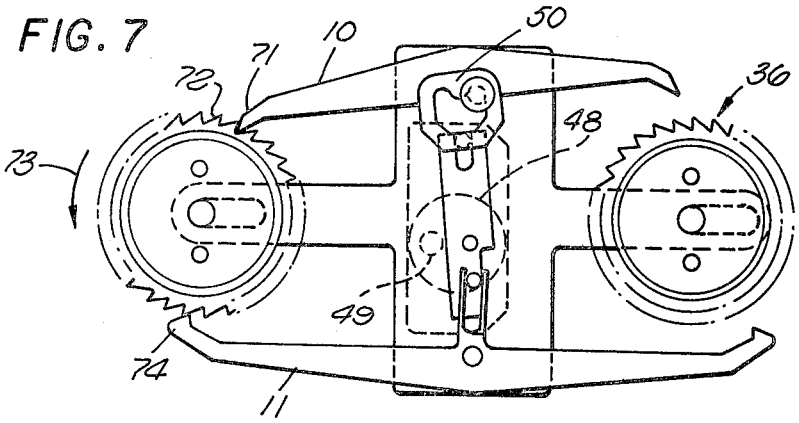
FIG. 7 is an operational view showing an engagement of a push pawl and a disengagement of a pull pawl shown in FIG. 2.

In FIGS. 7 and 8, ratchet wheel 35 is being driven.

In FIG. 7, when cam 48 is in the position shown, a push pawl 71 has just fallen off of a ratchet wheel tooth 72 and is about to rotate ratchet wheel 35 in the direction of an arrow shown at 73. During this rotation, arm 11 has a pull pawl 74 which moves out over the teeth of the ratchet wheel 35 to the left. After motor shaft 49 has turned, as shown in FIG. 8, pull pawl 74 is engaged with ratchet wheel 35. With only a modest tolerance, it is possible to push ratchet wheel 35 counterclockwise with push pawl 71 and have pull pawl 74 fully engaged and pulling in the same counterclockwise direction allowing very little or no reduction in the tension of the ribbon 18. In the prior art such tension reduction could cause a ratchet wheel to advance and then to reverse the same amount.

In other words, in FIG. 7 for example, pawl 71 engages ratchet wheel 35 before the tension of ribbon 18 is allowed to move ratchet wheel clockwise and pawl 71 almost simultaneously engages ratchet wheel 35 on or before the time that pawl 74 disengages ratchet wheel 35. Conversely, pawl 74 engages more or less simultaneously when pawl 71 disengages. Operation of ratchet wheel 36 is the same.

Note will be taken that all four pawl engagements and disengagements of the present invention are produced by the reciprocatory movement of plate 33 by cam 48 rotating in recess 47. The same is true of the transfer.

Arms 10 and 11 rotate ratchet wheel 36 in a manner similar to the manner that ratchet wheel 35 is rotated.

The transfer is illustrated by the solid and dotted lines in FIG. 6 where ratchet wheel 36 and spool 20 are being driven. A conventional typewriter ribbon end is fixed to each of spools 19 and 20 as is conventional when it runs out of ribbon. In the structures illustrated in FIG. 9, spool 19, when it runs out of ribbon, resists movement of ribbon 18 in direction 76. Before transfer, pin 52 (FIG. 2) rests in cradle 56 because spool 20 is rotated by virtue of its connection with ratchet wheel 36 through pins 41 and 42. Cam 48 then, at the end of the ribbon, in attempting to advance ratchet wheel 36, moves plate 33 to the left, as viewed in FIG. 2, and the resistance of ratchet wheel 36 to rotate because spool 19 has run out of ribbon causes arm 10 and 11 to move to the left with plate 33. At the end of the transfer, pin 52 rests in cradle 55.

Note will be taken that at the end of the ribbon on spool 19, spool 19, through ribbon 18, eventually holds spool 20 and ratchet wheel 36 in a substantially fixed position. This means as the righthand pawl of arm 10 (FIG. 2) is effectively stopped by ratchet wheel 36 and continued movement of plate 33 to the right causes arm 10 to move to the left relative to plate 33.

Transfer from the drive of ratchet wheel 35 to that of ratchet wheel 36 is the converse of transfer in the reversed direction.

Spools 19 and 20 may be removably secured to ratchet wheels 35 and 36 in any conventional manner. For example, see U.S. Pat. No. 3,752,290 issued Aug. 14, 1973.

Although no drag is necessary on ratchet wheels 35 and 36, some small drag is preferably provided to keep spools 19 and/or 20 from unreeling loose ribbon by the ribbon's own weight when the ribbon is not threaded. A modest drag is preferably provided as indicated by the use of spring 69 as shown in FIG. 4. From the foregoing, it should be appreciated that drag may be provided on ratchet wheels 35 and 36 and/or spools 19 and 20 with springs or otherwise.

It is one outstanding feature of the present invention that little or no drag is necessary. This makes it possible to use a smaller motor 24 than is conventional, and less power.

The present invention makes drag unnecessary because pawl 71 (FIG. 8) alternately engages ratchet wheel 35 with pawl 74, and there is an overlap. In other words, ratchet wheels 35 and 36, when driven, are always positively contacted by at least one pawl to limit slippage essentially to less than one tooth.

If desired, each ratchet wheel may be driven in equal increments where the increment may be one tooth or an integral number of teeth, e.g., preferably three teeth.

What is claimed is:

1. In a printer or the like, the combination comprising: a base; a member guided to reciprocate on said base; first and second pins having axes, said pins being fixed relative to said base in a manner such that a plane through said axes is approximately normal to said base and approximately parallel to said reciprocatory movement of said member; first and second ratchet wheels mounted on said first and second pins and rotatable about the respective axes thereof; first and second spools releasably fixed relative to said first and second ratchet wheels, respectively; a ribbon having first and second end portions wound in opposite directions around said first and second spools, respectively, said ribbon having an intermediate portion, said base having means to guide said ribbon intermediate portion; a first arm pivoted from said member spanning a first side of said ratchet wheels; a second arm pivoted from said member spanning a second side of said ratchet wheels; first pawls on respective ends of the first and second arms for selectively engaging and turning said first ratchet wheel; second pawls on the opposite ends of said first and second arms for selectively engaging and turning said second ratchet wheel; means mounted between said base and said member to reciprocate said member; transfer means linking said first and second arms and being responsive to reciprocation of said member during increased tension on said ribbon for determining which of said first and second ratchet wheels is turned by spreading the first pawl on each of said arms out of contact with said first ratchet wheel and for placing said second pawls in position to engage said second ratchet wheel in response to said increased tension being caused when the spool fixed relative to said second ratchet wheel runs out of ribbon and by spreading the second pawl on each of said arms out of contact with the second ratchet wheel and for placing said first pawls in position to engage said first ratchet wheel in response to said increase in tension being caused when the spool fixed relative to said first ratchet wheel runs out of ribbon; and means responsive to reciprocation of said member to cause one of said ratchet wheel engaging pawls on each of said arms to engage the appropriate ratchet wheel alternately to rotate the ratchet wheel step-by-step in successive increments in the same direction therearound, one of said ratchet pawls always being in contact therewith.

2. The invention as defined in claim 1, wherein both of said ratchet wheels have teeth, said pawls on said first arm being constructed to push teeth of corresponding ratchet wheels during operation.

3. The invention as defined in claim 2, wherein said pawls on said second arm are constructed to pull teeth of corresponding ratchet wheels during operation.

4. The invention as defined in claim 3, wherein a linkage is connected from said first arm to said second arm to tilt said second arm during transfer, spring means being provided between said second arm and said linkage to bias said second arm alternately against said ratchet wheels depending upon the last direction of transfer.

5. The invention as defined in claim 4, wherein said linkage includes a pin, said second arm having a bifurcated leaf spring fixed thereto straddling said linkage pin.

6. The invention as defined in claim 3, wherein the pivot between said first arm and said member includes a heartshaped opening and a transfer pin therein, the convex point of the heart extending in the general direction of the pivot axis of said second arm, and a tension spring connected from a first connection point at the central portion of said first arm below the axis of said transfer pin to said member at a second connection point closer to said second arm than said first connection point.

7. The invention as defined in claim 3, wherein said transfer means causes the pivot axis of said first arm to move relative to said member toward the ratchet wheel to be engaged.

8. The invention as defined in claim 7, wherein a linkage is connected from said first arm to said second arm to tilt said second arm during transfer, spring means being provided between said first arm and said member to bias said first arm alternately against said ratchet wheels depending upon the last direction of transfer.

9. The invention as defined in claim 8, wherein the pivot between said first arm and said member includes a heart-shaped opening and a transfer pin therein, the convex point of the heart extending in the general direction of the pivot axis of said second arm, said spring means including a tension spring connected from the central portion of said first arm below the axis of said transfer pin to said member at a point closer to said second arm than to said first arm.

10. The invention as defined in claim 9, wherein said linkage includes a pin, said second arm having a bifurcated leaf spring fixed thereto straddling said linkage pin.

11. The invention as defined in claim 10, wherein said ribbon is an inked ribbon, said base including a platen next to said ribbon, means to advance paper between said ribbon and said platen, and a print head supported on said base in a position to mark said paper by striking.

12. The invention as defined in claim 1, wherein both of said ratchet wheels have teeth, said pawls on said second arm being constructed to pull teeth of corresponding ratchet wheels during operation.

13. The invention as defined in claim 1, wherein said transfer means causes the pivot axis of said first arm to move relative to said member toward the ratchet wheel to be engaged.

14. The invention as defined in claim 1, wherein said ribbon is an inked ribbon, said base including a platen next to said ribbon, means to advance paper between said ribbon and said platen, and a print head supported on said base in a position to mark said paper by striking.

* * * * *